United States Patent [19]

Bucklisch

[11] 3,948,175

[45] Apr. 6, 1976

[54] WARHEAD

[75] Inventor: Ludwig Bucklisch, Unterach, Austria

[73] Assignee: Dynamit Nobel Aktiengesellschaft, Germany

[22] Filed: July 2, 1974

[21] Appl. No.: 485,268

Related U.S. Application Data

[60] Division of Ser. No. 300,226, Oct. 24, 1972, Pat. No. 3,857,338, which is a continuation-in-part of Ser. No. 112,379, Feb. 3, 1971, abandoned.

[30] Foreign Application Priority Data

Feb. 3, 1970 Germany ..... 2004637

[52] U.S. Cl. ..... 102/5; 102/61

[51] Int. Cl.[2] ..... F42B 25/02; F42B 13/38

[58] Field of Search ..... 102/4, 5, 7.2, 7.4, 61, 102/88

[56] References Cited

UNITED STATES PATENTS

| | | | |
|---|---|---|---|
| 1,277,271 | 8/1918 | Sutch | 102/5 |
| 1,289,483 | 12/1918 | Leal | 102/5 |
| 1,300,333 | 4/1919 | Berry | 102/5 |
| 2,711,694 | 6/1955 | Hilliard | 102/5 |
| 3,439,610 | 4/1969 | Myers | 102/4 |

*Primary Examiner*—Charles T. Jordan
*Attorney, Agent, or Firm*—Craig & Antonelli

[57] ABSTRACT

Warhead for bombs, projectiles, rockets and the like having a casing with several projectiles accommodated therein. The projectiles are disposed in launcher tubes which are connected with each other by a common central connecting component to form an independent unit in a symmetrical arrangement with respect to the axis of the component. The independent unit is equipped with a descent-retarding device on one side thereof positioned toward one direction of the axis, while the other side is provided with a stabilizing device toward the other direction of the axis to vertically position the axis during descent. Preferred embodiments use parachutes as descent-retarding devices and rigid stabilizer rods or flexible members to interconnect a stabilizing weight with the respective independent units. Accommodations are made to telescope the stabilizer rods into one another to limit the total space utilized in the stored position. In the embodiments utilizing flexible members, the weights are provided with a recess at the undersides thereof to accommodate the next adjacent parachute and independent unit when in the stored position in the warhead.

10 Claims, 4 Drawing Figures

WARHEAD

This is a division of application Ser. No. 300,226, filed Oct. 24, 1972.

Said application Ser. No. 300,226 is now U.S. Pat. No. 3,857,338. This earlier application Ser. No. 300,226 was a continuation-in-part of my copending application Ser. No. 112,379, filed Feb. 3, 1971, now abandoned.

BACKGROUND OF THE INVENTION

The present invention relates to a warhead for bombs, projectiles, shells and rockets having a casing or jacket and several projectiles accommodated therein.

Multiple warheads normally consist of individual projectiles housed in a casing and serve to increase the effect in the target area. They can be employed in bombs, projectiles, shells, rockets and in submarine ammunition, wherein the subsidiary or secondary projectiles detach from the main body at a more or less large distance from the target. The advantage of these multiple warheads resides in a larger area or surface effect. In this connection, two systems can be distinguished, namely projected or dropped projectiles moving in the vertical direction and projectiles which are fired horizontally or at a certain elevation The scattering or area effect is very different for the two systems. Projected or dropped projectiles are usually within a very narrow impact range. Therefore, the effect thereof against area targets, such as, for example, infantry, tank aggregations and the like, is limited. Multiple warheads wherein the individual projectiles are fired laterally utilize a more or less horizontal flight path and affect a large space. The highest effect of these types of warheads is obtained if the firing of the individual projectiles takes place only at a minor distance from the ground and if the axis of the main body is vertical during this procedure. However, this angle of impact is, in most cases, not exactly vertical due to a great variety of influences during dropping or firing. A large portion of the subsidiary projectiles then impinges on the ground at an extremely short distance or have an upwardly oriented trajectory. The scattering range and thus the possibility of being effective are very restricted.

SUMMARY OF THE INVENTION

It is the aim of the present invention to overcome the problems and disadvantages encountered in the prior art arrangements.

The foregoing problems have been solved in accordance with the present invention by providing a multiple warhead containing individual groups of secondary projectiles which are combined into a system. The secondary projectiles are disposed in such a manner that the individual group impinges as vertically as possible in its central axis or axis of symmetry, and all the projectiles of the group are fired shortly above ground or in front of the target in a desired angle of inclination, in addition to being as uniformly distributed as possible toward all sides.

In accordance with the present invention, the projectiles are disposed in launcher tubes which are connected with each other by means of a common central connecting element to form an independent unit consisting of several, or respectively several components in a symmetrical, preferably radial, arrangement with respect to the axis of the connecting element. Furthermore, the provision is made that the units are equipped, on one side thereof positioned toward one direction of the axis, with a descent-retarding device such as, for example, a parachute and, on the side positioned toward the other direction of the axis, with a stabilizing device for effecting the vertical position of the axis during descent.

Advantageously, the launcher tubes can be connected to the connecting element in a ray-like manner, i.e. in the form of a radial extension, wherein a more or less large angle of inclination is provided for the tubes depending on the velocity of the projectiles to be fired therefrom and depending on the distance of the target. When being dropped from the air, the falling speed of the unit is suitably braked by means of a parachute or by means of another braking device such as, for example, braking surfaces, drag flaps or the like in such a manner that this speed does not exceed a desired value such as, for example, 5–10 m/sec upon impact of the unit on the ground. Due to the stabilizer device disposed on the underside of the unit, the center of gravity is disposed very low in relation to the suspension on the parachute or also in relation to other braking devices, so that the axis of the system is adjusted into an at least approximately vertical position, independently of the parachute or the other braking device provided.

According to a further feature of the present invention, the provision is made to construct the stabilizing device as a tube having a massive free end and being rigidly connected with the connecting element. In this respect, a detonator system can advantageously be provided in the tube. This system effects the firing of the projectile from the tubes by means of a percussion fuze accommodated in the massive end of the tube upon impact with the ground such as, for example, by means of propellant charges disposed within these tubes. However, the same effect can be achieved by constructing the stabilizing device in accordance with the present invention as a weight connected with the connecting element by means of a flexible connection such as, for example, by means of a wire, a line, a chain or the like. Suitably, this weight is provided with a relatively large impingement surface, so that assurance is obtained that, even in case of low specific pressures per unit area, a sufficiently large force required for triggering a mechanical or an electrical detonator is still produced upon impact with the ground.

Instead of suspending the weight at the connection element, it is also possible to effect the suspension of the weight at the individual launcher tubes. This last-mentioned arrangement makes it possible, if a pivotally movable connection is provided according to the present invention between the tubes and the connection element, for the launcher tubes which may be provided in the folded condition in the projectile casing due to the small diameter of the projectile casing to be placed automatically, i.e. without any special opening mechanisms, into their swung-out or pivoted-out position after leaving the projectile casing, under the effect of the weight or, on the other hand, by springs. The launcher tubes can be than locked into position by means of a locking device. The flexible suspension of a weight at the unit also has the advantage, in particular, that the connecting chain or the like can be selected to be very large or long, independently of the size of the projectile casing, so that a high stabilizing effect is achieved. In a suitable manner, the stabilizing weight is provided on its underside with a recess or the like, whereby the possibility is obtained to accommodate in this recess the parachute of a unit disposed in front thereof and thus to save a considerable amount of space.

In connection with several units accommodated in the warhead casing, the present invention furthermore provides that the individual units are joined to one another by means of lines or the like so that, depending on the length of the connecting cord, one unit automatically pulls the subsequent unit out of the warhead casing after the elapse of a more or less long period of time. Here the provision can, of course, be made that the connection between respectively two units is automatically severed at a predeterminable instant. The withdrawal of the units from the warhead casing can be also effected in some other manner such as, for example, by means of chronologically settable firing devices or also by means of a firing device that can be triggered by remote control or the like.

The projectiles housed in the launcher tubes can be in the form of fragmenting grenades, smoke bombs, or anti-tank shells. It is also possible to employ explosive devices of the mine type having their own detonator mechanism which detonates these devices only after a certain period of time or under certain conditions. It is also possible to accommodate various types of the above-mentioned effective devices in one warhead casing, so that a very versatile effect at the target is obtained.

BRIEF DESCRIPTION OF THE DRAWINGS

These and further features, objects and advantages of the present invention will become more apparent from the following description when taken in conjunction with the accompanying drawing which shows, for purposes of illustration only, several embodiments in accordance with the present invention and wherein.

DETAILED DESCRIPTION OF THE DRAWING

Figure 1:
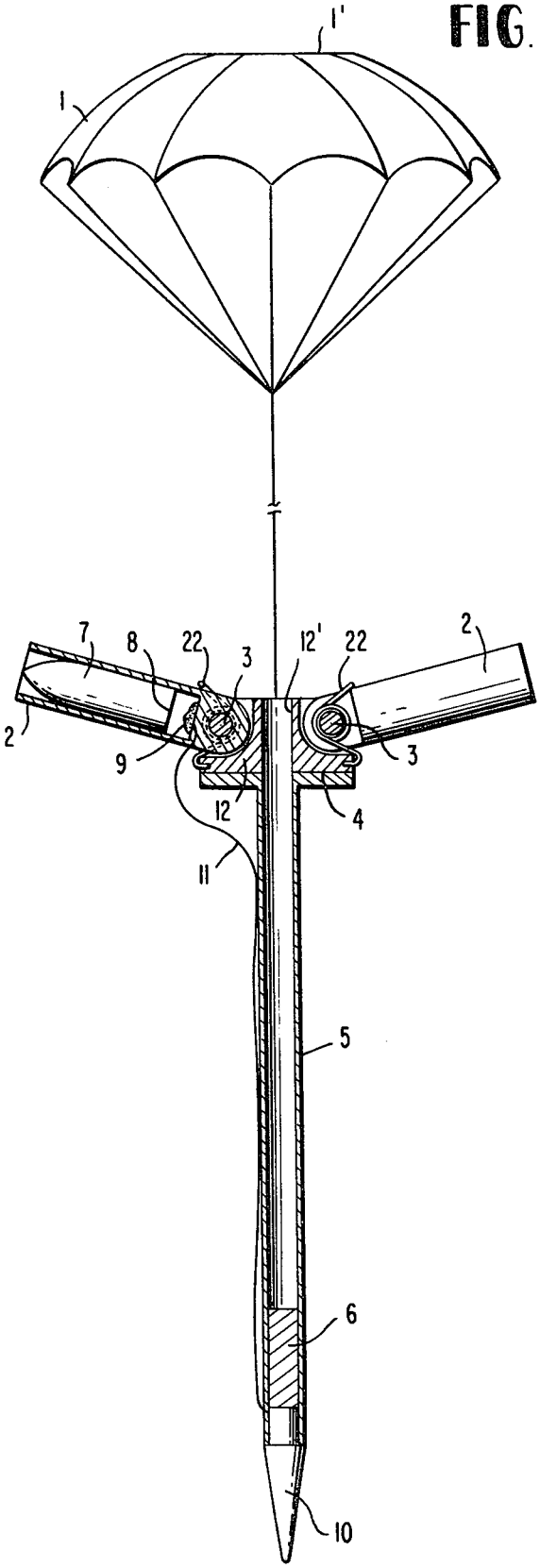
FIG. 1 is a schematic partially cross-sectional side view showing a unit in accordance with a first embodiment of the present invention during descent.

Referring now to the drawing and, in particular, to FIG. 1, the firing or launcher tubes 2 are disposed to be pivotally movable about the respective axes 3 at the central connecting element 12. The element 12 is suspended from the parachute 1 by lines of sufficient length to accommodate the pivotal movement of the launcher tubes 2 from a stored to an in use position. In the launcher tubes 2 are disposed the effective or active projectiles 7 with a propellant charge 8 and detonator charge 9. On the underside of the connecting element

12, the rigid rod like stabilizer body 5 in the form of a tube is attached and carries, at its free end, the tip in the form of, for example, an electrical contact detonator or fuze 10. The detonator charges 9 disposed in the range of the propellant charges 8 are in operative connection with the detonator 10 via the primer cord 11. In the lower portion, the stabilizer body 5 is filled with the weighting substance 6 such that this lower portion practically constitutes a massive, solid body. In the pivoted position of the launcher tubes 2, the latter are retained by the locking means designed generally by the numeral 4. Instead of the detonator or fuze illustrated, it is, of course, also possible to provide a mechanical percussion fuze in a conventional manner. For example, this fuze could be pneumatically triggered upon firing by means of compressed gas.

Figure 2:
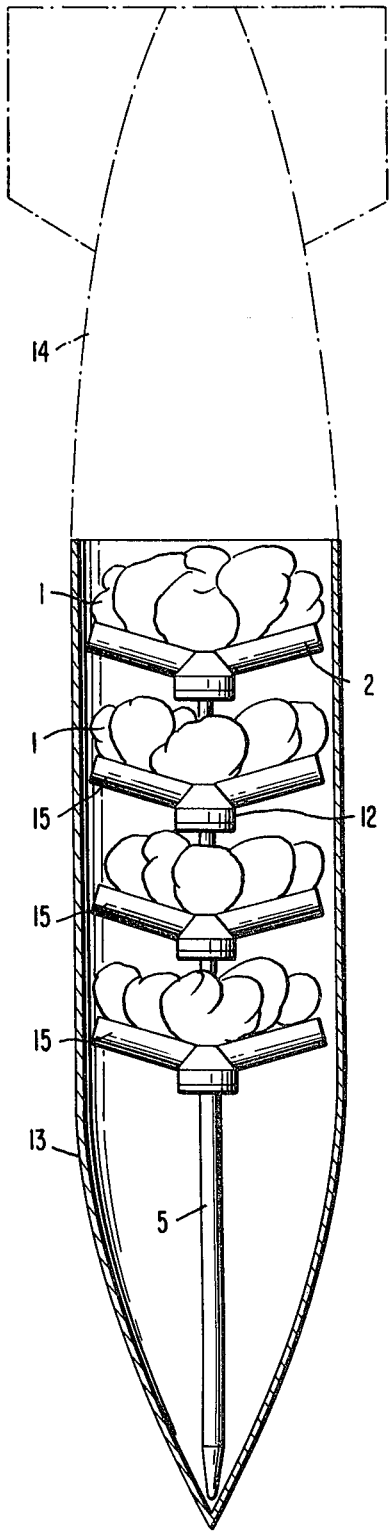
FIG. 2 is a schematic partially cross-sectional side view representation of a bomb having several units, corresponding to the units of FIG. 1 except that the launcher tubes are rigidly connected to the connecting element, disposed in series within the warhead casing in accordance with the present invention.

This FIG. 1 embodiment is provided with a vent hole 1' in the parachute 1 and an opening 13' in the connecting element to accommodate telescoping of stabilizer 5 of one unit into the connecting element and stabilizer of the unit disposed immediately below when in the stored condition in the warhead or the like. FIG. 2 and the associated description disclose such a telescoping stored arrangement for units similar to this FIG. 1 embodiment except that the launching tubes are rigid with the connecting element in FIG. 2. In the stored condition, the FIG. 1 units may have their launcher tubes 2 folded upwardly in a manner similar to the arrangement shown in FIG. 4. The stabilizers 5 are constructed of successively smaller diameters to accommodate telescoping of one stabilizer into another. In the stored position the parachute is folded so as to leave an opening through the vent hold thereof to accommodate the telescoping.

The pivoting of the launcher tubes 2 from a substantially vertical stored position to an in-flight and in-use position as shown in FIG. 1 can be effected by springs, such as schematically shown at 22. These springs 22 may effect pivotal movement of the launcher tubes once they have left the warhead casing. A latching arrangement (not shown) which is triggered by opening forces of the parachute may also be utilized to prevent pivoting movement of the launcher tubes by the spring until the parachute has opened may also be advantageously used. Also, the weight of the launcher tubes 2 and projectiles 7 may effect the pivotal movement of the launcher tubes 2 once the unit has left the warhead casing. A latching mechanism such as illustrated at 4' in FIG. 3 may advantageously be used with the FIG. 1 embodiment to lock the launcher tubes 2 in the pivoted in-use position.

According to FIG. 2, four units 15 having rigid launcher tubes 2 are disposed in series within the casing 13. This design is, of course, suitable only if the warhead casing 13 can be formed with a sufficiently large diameter. However, there is also the possibility in this situation to attach the tubes at the connecting element 12 in a pivotally movable manner as above described. The rod-like stabilizer bodies 5 are telescoped into one another in this embodiment through openings in the connecting elements similar to openings 12' in the FIG. 1 element, so that a considerable space saving is obtained. Of course, this arrangement and design has the prerequisite that the bodies 5 are constructed successively with a smaller diameter. The parachutes 1 are disposed in a folded condition around the bodies 5 above the launcher tubes 2 so as to accommodate telescoping of adjacent units.

At a desired point in time, which can be determined by a clock or timing mechanism, or by an electrical or a phrotechnical method, the tail 14 of the bomb (indicated in dashed lines) or, in the case of a projectile, the projectile base or, in case of a rocket, the propulstion unit is severed from the warhead in a conventional manner such as, for example, by a snap-off action or also in some other like manner. The rearmost unit is now free and can be pulled or pushed out. The time interval of the drops can be determined mechanically. Thus, it is possible, for example to connect the individual units with a line of a certain length, so that an exactly determined spacing, e.g. 50 m, is maintained. In this way, a desired optimum scattering effect can be achieved.

Accordingly, the present invention having the above-described warhead with units operates so that a bomb, a projectile or a rocket has a detachable bottom or base which is separated from the warhead at an exactly predetermined instant. The individual units are than pulled or pushed out of the warhead in the rearward direction at certain intervals and float to the ground while attached to the braking device. During this process, the rod arranged at the units has such a stabilizing effect that the central axis remains extensively vertical. Upon impingement of the rod on the ground, the detonator mechanism is triggered, and the projectiles present in the tubes disposed in the most favorable elevation are set into motion by the propellant charges and fired. U.S. Pat. No. 2,894,457 discloses an arrangement that could be used with the present invention as a detonator mechanism. Of course, it would also be possible to provide, in lieu of a percussion fuze, also another type of primer such as, for example, an electrical or electronic remote control.

Figure 3:
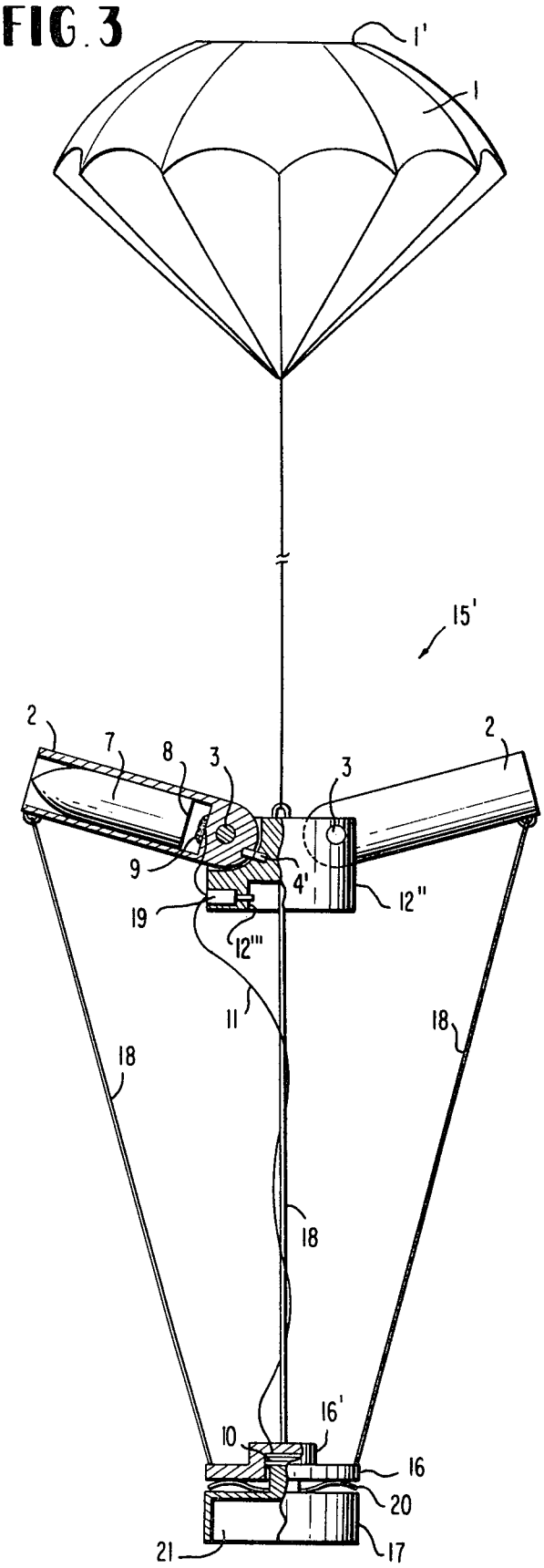
FIG. 3 is a schematic, partially cross-sectional side view showing a unit in accordance with a third embodiment of the present invention during the descent.
Figure 4:
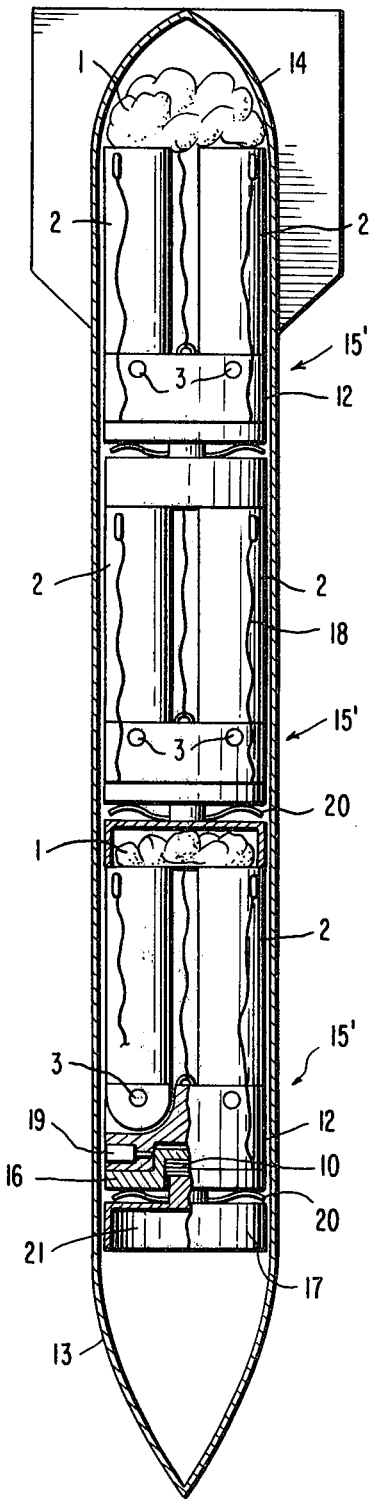
FIG. 4 is a schematic partially cross-sectional side view representation of a bomb having several units corresponding to the FIG. 3 embodiment disposed in series within the warhead casing in accordance with the present invention.

FIGS. 3 and 4 illustrate a third embodiment of the present invention with reference numerals corresponding to the reference numerals of FIGS. 1 and 2 for like parts.

According to FIG. 3, the weight 16, 17 is connected with the front or outward ends of the firing tubes 2 via the cords or ropes 18, so that the tubes, under the pulling effect of the weight, are unfolded about their pivot axes 3 into the firing position shown. The part 17 of the weight includes a recess 21 at its underside to accommodate the next adjacent unit, when in the stored condition as shown in FIG. 4. A piezoelectric element 10 is disposed between the two parts 16, 17; this element produces the ignition voltage when the element 17 impinges upon the target and thereby places the piezoelectric element 10 under pressure. In order to avoid an unintended pressure load on the piezoelectric element 10, for example by accelerative shocks, the spring 20 is arranged between the parts 16, 17. Via the ignition line 11, the piezoelectric element 10 is connected to the primer charge 9. An electromechanical safety switch 19 may be disposed between element 12 and part 16 to prevent inadvertent ignition of primer charge 9 when in the stored condition.

In FIG. 4, three units 15' are shown arranged in series within the envelope or warhead casing 13, the parachute 1 of one unit 15 being accommodated in the recess 21 of the unit 15' disposed thereabove. The part 16 engages, with a central projection 16', a corresponding recess 12''' of the connecting element 12'', whereby the safety switch 19 is opened and consequently a triggering of the detonator charges 9 is impossible, even in case of an unintended voltage generation within the piezoelectric element 10. The ignition lines 11 and the cords 18 are arranged folded-up laterally beside the units 15 within the envelope 13.

When in the stored condition shown in FIG. 4, the parachutes and parachute connecting lines are folded up in the recess 21 of the unit disposed immediately above, which feature, combined with the easily storable flexible cords and lines 11 and 18, provides for a very compact storage arrangement while also providing a very stable unit for descent and use.

Latching mechanism 4' of FIG. 3 preferably includes a cylindrical pin 4 provided in a corresponding bore in connecting member 12 which is pressed partially in a corresponding counter bore of the associated launching tube 2 by a small cylindrical coil spring when the tubes have been pivoted to their firing position. That is the cylindrical pin is snapped into locking position by the spring upon alignment of the bores.

Each of the above-described embodiments of the present invention provide advantages as regards to space utilization in the stored condition and as regards to the serial withdrawal of the unit from a warhead without impeding one another.

While I have shown and described several embodiments in accordance with the present invention, it is to be clearly understood that the same is susceptible of numerous changes and modifications as will be apparent to one skilled in the art. I, therefore, do not wish to be limited to the details shown and described herein, but intend to cover all such changes and modifications as are encompassed by the scope of the present invention.

It is further noted that the line 11 of the FIG. 1 embodiment may alternatively extend through the opening in the tube. The dimensions of the lines 11 and the tubes 5 are arranged to accommodate the telescoping of the tubes 5.

I claim:

1. An independent weapon unit for use with warheads in bombs, rockets and the like, of the type which accommodate a plurality of independent weapon units in a single warhead; said independent weapon unit comprising: common central connecting means having a centrally disposed longitudinally extending axis, a plurality of launcher tubes connected to said central connecting means, each of said launcher tubes including means for accommodating at least one projectile, descent retarding means connected to said central connecting means for controlling the rate of descent of said weapon unit, stabilizing means connected to said central connecting means for stabilizing the weapon unit during the descent thereof, said descent retarding means and said stabilizing means being spaced from one another along said longitudinal axis at opposite sides of said central connecting means, and storage accommodating means permitting storage of a plurality of said independent weapon units adjacent one another extending in the direction of said longitudinal axis with the combined length of the stabilizing means of said plurality of independent weapon units in the stored condition being less than the sum of the length of the individual stabilizing means when the independent weapon units are in an operative descent condition, wherein said stabilizer means is constructed as a weight attached to one of said plurality of launcher tubes and said central connecting means by flexible attaching lines, and wherein said storage accommodating means includes constructing said attaching lines sufficiently flexible to accommodate folding of said attaching lines and movement of said weight closer to said central connecting means in a stored condition.

2. A weapon unit according to claim 1, wherein said storage accommodating means further comprises a recess formed in the side of the weight opposite said central connecting means, said recess including means for accommodating the descent retarding means of the next adjacent weapon unit when in a stored condition in a warhead.

3. A weapon unit according to claim 1, wherein the launcher tubes are pivotally connected with the central connecting means, wherein means are provided for automatically pivoting said launcher tubes to an operative position when said weapon unit is released from a warhead, wherein means are provided for locking said launcher tubes in the operative position, and wherein said last mentioned means includes spring loaded detent means mounted on said central connecting means for engagement with respective apertures in said launcher tubes.

4. A weapon unit according to claim 1, wherein said descent retarding means includes a foldable parachute.

5. A weapon unit according to claim 1, wherein said launcher tubes are symmetrically arranged with respect to said longitudinal axis.

6. A weapon unit according to claim 1, wherein the launcher tubes are pivotally connected with the central connecting means.

7. A weapon unit according to claim 1, wherein said launcher tubes are rigidly fixed to said central connecting means.

8. A weapon unit according to claim 1, wherein propellant charge means are located in each launcher tube for firing the projectiles, and wherein operating fuse means are provided at the free end of said stabilizing means for ignition of the propellant charge means upon impact of the stabilizing means with a target.

9. An independent weapon unit for use with warheads in bombs, rockets and the like, of the type which accommodate a plurality of independent weapon units in a single warhead; said independent weapon unit comprising: common central connecting means having a centrally disposed longitudinally extending axis, a plurality of launcher tubes connected to said central connecting means, each of said launcher tubes including means for accommodating at least one projectile, descent retarding means connected to said central connecting means for controlling the rate of descent of said weapon unit, stabilizing means connected to said central connecting means for stabilizing the weapon unit during the descent thereof, said descent retarding means and said stabilizing means being spaced from one another along said longitudinal axis at opposite sides of said central connecting means, and storage accommodating means permitting storage of a plurality of said independent units adjacent one another extending in the direction of said longitudinal axis with the combined length of the stabilizing means of said plurality of independent weapon units in the stored condition being less than the sum of the length of the individual stabilizing means when the independent weapon units are in an operative condition and further comprising a warhead casing and at least one further independent weapon unit, and wherein said weapon units are connected in series within said casing by menas of lines, whereby the units can be pulled out of the casing by the next adjacent weapon unit at predetermined chronological intervals.

10. A weapon unit according to claim 9, wherein the launcher tubes on each independent unit are symmetrically arranged with respect to said longitudinal axis, and wherein the descent retarding means include a parachute.

* * * * *